US012104334B2

(12) United States Patent
Persson

(10) Patent No.: US 12,104,334 B2
(45) Date of Patent: Oct. 1, 2024

(54) METHOD OF CONTROLLING OPERATION OF A VIBRATORY ROLLER

(71) Applicant: Dynapac Compaction Equipment AB, Karlskrona (SE)

(72) Inventor: Andreas Persson, Karlskrona (SE)

(73) Assignee: Dynapac Compaction Equipment AB (SE)

( * ) Notice: Subject to any disclaimer, the term of this patent is extended or adjusted under 35 U.S.C. 154(b) by 230 days.

(21) Appl. No.: 17/280,502

(22) PCT Filed: Sep. 27, 2019

(86) PCT No.: PCT/SE2019/050927
§ 371 (c)(1),
(2) Date: Mar. 26, 2021

(87) PCT Pub. No.: WO2020/067984
PCT Pub. Date: Apr. 2, 2020

(65) Prior Publication Data

US 2021/0340714 A1 Nov. 4, 2021

(30) Foreign Application Priority Data

Sep. 28, 2018 (SE) ..... 1851171-7

(51) Int. Cl.
*E01C 19/28* (2006.01)

(52) U.S. Cl.
CPC ..... *E01C 19/286* (2013.01)

(58) Field of Classification Search
CPC ..... E01C 19/286
USPC ..... 404/84.05–84.5, 117, 72, 75
See application file for complete search history.

(56) References Cited

U.S. PATENT DOCUMENTS 3,797,954 A 3/1974 Harris
5,164,641 A 11/1992 Quibel et al.
5,177,415 A * 1/1993 Quibel ..... E01C 19/288 318/128
5,695,298 A 12/1997 Sandstrom
(Continued)

FOREIGN PATENT DOCUMENTS

CA 1205547 A 6/1986
CN 2438748 Y 7/2001
(Continued)

*Primary Examiner* — Raymond W Addie
(74) *Attorney, Agent, or Firm* — Condo Roccia Koptiw LLP

(57) ABSTRACT

The present invention relates to a method of controlling operation of a vibratory roller (1) comprising a roller drum (3) and a vibratory mechanism (2) having at least two amplitude settings. The method comprises operating the vibratory mechanism (2) in one of said at least two amplitude settings; maintaining a predefined phase angle by controlling the vibration frequency of the vibratory mechanism (2); monitoring a bouncing indication value (BIV), said bouncing indication value being calculated based on an acceleration signal indicative of the vertical acceleration of the roller drum (3); and turning off the vibratory mechanism (2) upon detection of a resonance meter value (BIV) that exceeds a predetermined bouncing value (BV), thereby preventing the vibratory roller from operating in a bouncing mode of operation.

15 Claims, 4 Drawing Sheets

(56) References Cited

U.S. PATENT DOCUMENTS

| | | | | |
|---|---|---|---|---|
| 5,797,699 | A * | 8/1998 | Blancke | E01C 19/288 404/117 |
| 6,431,790 | B1 | 8/2002 | Anderegg et al. | |
| 6,808,336 | B2 | 10/2004 | Fervers et al. | |
| 7,168,885 | B2 * | 1/2007 | Rio | E01C 19/288 404/113 |
| 7,908,084 | B2 | 3/2011 | Anderegg et al. | |
| 9,016,710 | B2 * | 4/2015 | Wagner | E01C 19/26 280/468 |
| 9,534,995 | B2 * | 1/2017 | Stoeckel | E02D 1/022 |
| 9,737,910 | B2 * | 8/2017 | Smith | B06B 1/162 |
| 10,435,852 | B2 * | 10/2019 | Pistrol | E01C 19/288 |
| 2003/0180093 | A1 | 9/2003 | Fervers | |
| 2011/0158745 | A1 | 6/2011 | Oetken et al. | |
| 2012/0045281 | A1 * | 2/2012 | Wagner | B62D 12/00 404/117 |
| 2015/0241333 | A1 | 8/2015 | Pistrol et al. | |
| 2015/0337502 | A1 * | 11/2015 | Wadensten | E01C 19/24 404/117 |
| 2015/0362414 | A1 * | 12/2015 | Stoeckel | E02D 1/022 404/128 |
| 2016/0298308 | A1 * | 10/2016 | Oetken | E01C 19/288 |
| 2017/0121917 | A1 * | 5/2017 | Frelich | E01C 19/26 |
| 2017/0306575 | A1 * | 10/2017 | Utterodt | E01C 19/288 |
| 2020/0018019 | A1 * | 1/2020 | Rudge | E01C 19/288 |

FOREIGN PATENT DOCUMENTS

| | | | | |
|---|---|---|---|---|
| CN | 2537732 | Y | 2/2003 | |
| CN | 101180438 | A | 5/2008 | |
| CN | 101503873 | A | 8/2009 | |
| CN | 101525862 | A | 9/2009 | |
| CN | 201358431 | Y | 12/2009 | |
| CN | 102182135 | A | 9/2011 | |
| CN | 104831602 | A | 8/2015 | |
| DE | 07045475 | * | 7/1995 | E01C 19/28 |
| DE | 10019806 | A1 | 10/2001 | |
| EP | 1334234 | A1 | 8/2003 | |
| WO | 95/10664 | A1 | 4/1995 | |

* cited by examiner

METHOD OF CONTROLLING OPERATION OF A VIBRATORY ROLLER

CROSS REFERENCE TO RELATED APPLICATIONS

This application is the National Stage Entry under 35 U.S.C. § 371 of Patent Cooperation Treaty Application No. PCT/SE2019/050927, filed Sep. 27, 2019, which claims priority from Swedish Application No. 1851171-7, filed Sep. 28, 2018, the contents of each of which are hereby incorporated by reference herein in their entireties.

TECHNICAL FIELD OF THE INVENTION

The present invention relates to a method of controlling operation of a vibratory roller.

BACKGROUND ART

Vibratory rollers are widely used to compact soil and asphalt e.g. in the construction of roads and buildings.

Compaction of soil is about rearranging soil particles into a more dense state, by reducing air voids and increasing the number of contact points between the soil particles. Vibratory compaction, in which dynamic forces are utilized, enables efficient compaction on most soils. Typically, a vibratory roller comprises eccentric weights mounted on a rotating shaft to cause a roller drum to vibrate at a certain vibration frequency. The forces from the roller drum cause pressure waves in the soil, which in turn set the soil particles in motion to rearrange into a more dense state.

Generally, a high contact force between the drum and the soil gives deeper compaction and a high amount of energy/impact creates powerful pressure waves to rearrange the soil particles. It is therefore desired to control the compaction process such that the contact force and the energy/impact is maximized, i.e. to emit energy into the ground in an efficient manner.

U.S. Pat. No. 6,431,790 B1 illustrates a method of compacting using a compacting device, such as e.g. a vibratory roller. According to this method measured data is analyzed to determine mechanical characteristics of the soil that is compacted. Based on analysis of the vibration of the soil compacting device and the soil together as a single oscillatory system, the vibration frequency of the compacting device is continuously adjusted so as to drive the single oscillatory system towards a characteristic resonance frequency for optimization of the compaction. Furthermore, the travel speed and the vibration amplitude are continuously adjusted.

However, this method is time-consuming and/or inefficient, especially at startup.

SUMMARY OF THE INVENTION

It is an object of the present invention to provide an improved method of controlling operation of a vibratory roller.

This and other objects that will be apparent from the following summary and description are achieved by a method according to the appended claims.

According to one aspect of the present disclosure there is provided a method of controlling operation of a vibratory roller comprising a roller drum and a vibratory mechanism having at least two amplitude settings. The method comprises operating the vibratory mechanism in one of said at least two amplitude settings; maintaining a predefined phase angle by controlling the vibration frequency of the vibratory mechanism; monitoring a bouncing indication value (BIV), wherein said bouncing indication value being calculated based on an acceleration signal indicative of the vertical acceleration of the roller drum; and turning off the vibratory mechanism upon detection of a bouncing indication value (BIV) that exceeds a predetermined bouncing value (BV), thereby preventing the vibratory roller from operating in a bouncing mode of operation.

A predefined phase angle, i.e. difference in angular position between an eccentric force generated by the vibratory mechanism and the displacement of the roller drum, is thus used to control the vibration frequency.

The bouncing value is indicative of a bouncing mode of operation of the vibratory roller. By turning off the vibrations when bouncing is detected harmful operation of the vibratory roller and crushing of the soil particles are prevented. Maximum vibration amplitude may be achieved immediately after startup, and the vibration frequency is quickly adjusted to the predefined phase angle without any tuning of the vibration amplitude. Optimal compaction is thus reached in a very fast and efficient manner compared to the method teached in U.S. Pat. No. 6,431,790 B1, which requires a considerable amount of time since a step less variable amplitude is adjusted several times, from a low amplitude, following a sophisticated startup procedure before optimal compaction can be reached. Hence, the method described in U.S. Pat. No. 6,431,790 B1 is time-consuming and/or inefficient, especially at startup, since it takes time to sample data values and analyze the data values to determine what adjustments that should be executed. During this time, the roller may have travelled several meters over the area to be compacted. This means that the area travelled while adjusting machine parameters is not compacted in the most optimal way.

The method according to the present disclosure thus provides fast and efficient compaction of an area to be compacted. Especially, this may be an advantage when the compaction involves several passes and the vibrations has to be started and stopped frequently, since optimal compaction is achieved shortly after startup of the vibrations. Furthermore, it requires less complicated mechanical mechanisms and/or control equipment, since the amplitude is set in a predetermined amplitude setting and is simply turned off upon detection of bouncing. Hence, a less costly and more robust method may be provided.

Preferably, said bouncing indication value is calculated continuously.

According to one embodiment the method comprises starting the vibratory mechanism in a high amplitude setting. This has the advantage that optimal compaction, for at least a majority of soil conditions, is reached in a very fast and efficient manner.

According to one embodiment the vibratory roller has two and only two amplitude settings, which provides for a very reliable and efficient control of operation.

According to one embodiment the calculation of said bouncing indication value comprises performing Fast Fourier Tranform of said acceleration signal.

According to one embodiment said phase angle is in the range of 110° to 150° and more preferably in the range of 125° to 135°.

These and other aspects of the invention will be apparent from and elucidated with reference to the claims and the embodiments described hereinafter.

BRIEF DESCRIPTION OF THE DRAWINGS

The invention will now be described in more detail with reference to the appended drawings in which.

DETAILED DESCRIPTION OF PREFERRED EMBODIMENTS OF THE INVENTION

Figure 1:
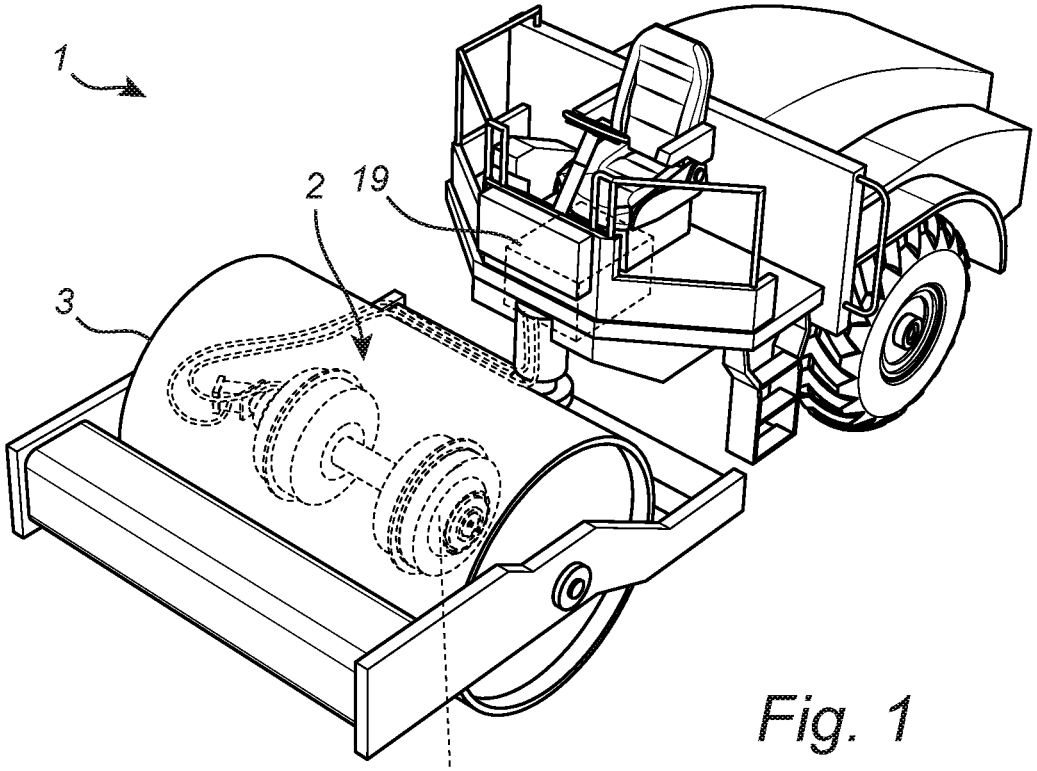
FIG. 1 illustrates a vibratory roller.

FIG. 1 illustrates a vibratory roller 1 comprising a roller drum 3, a vibratory mechanism 2 mounted inside the roller drum 3 and a control unit 19.

Figure 2:
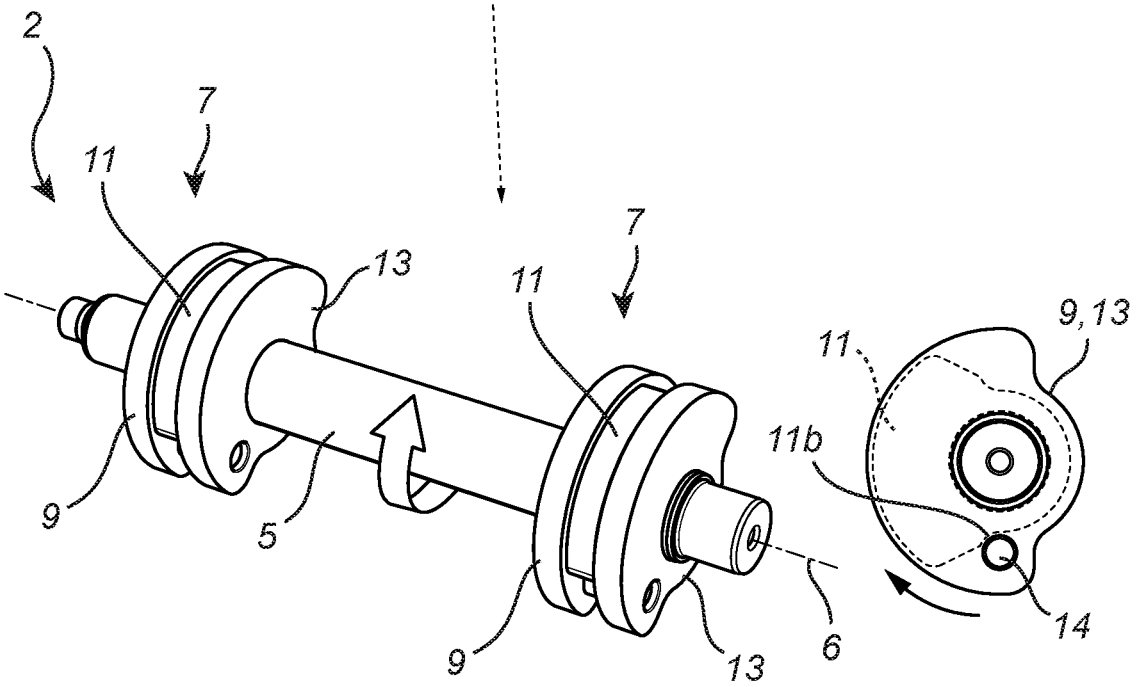
FIG. 2 illustrates a vibratory mechanism of the vibratory roller shown in FIG. 1.
Figure 3A:
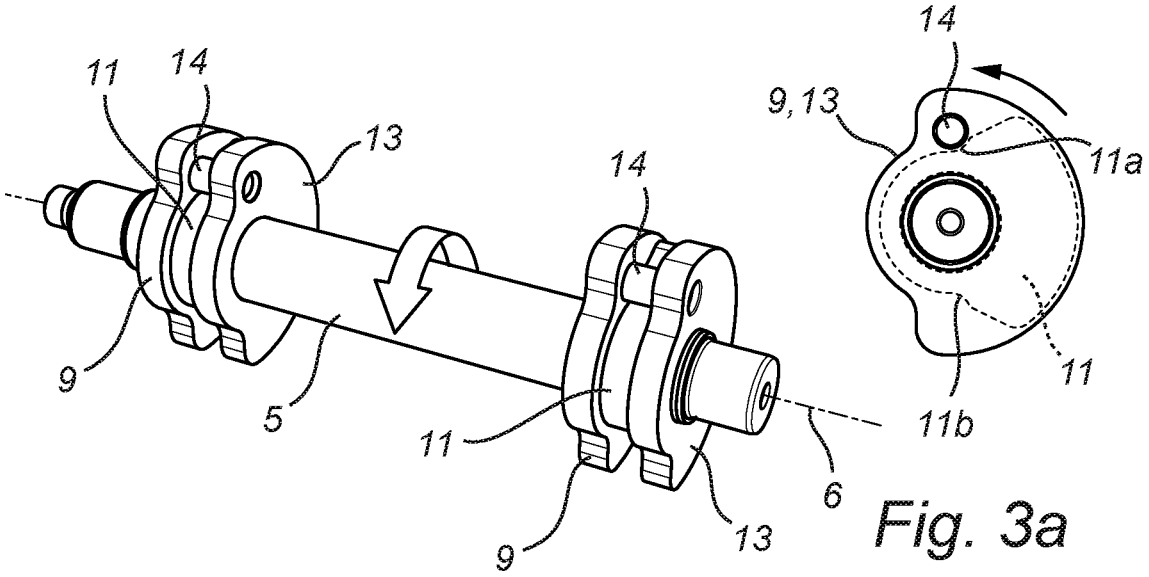
FIGS. 3*a-b* serve to illustrate the vibratory mechanism upon switching from a high amplitude setting to a low amplitude setting.
Figure 3B:
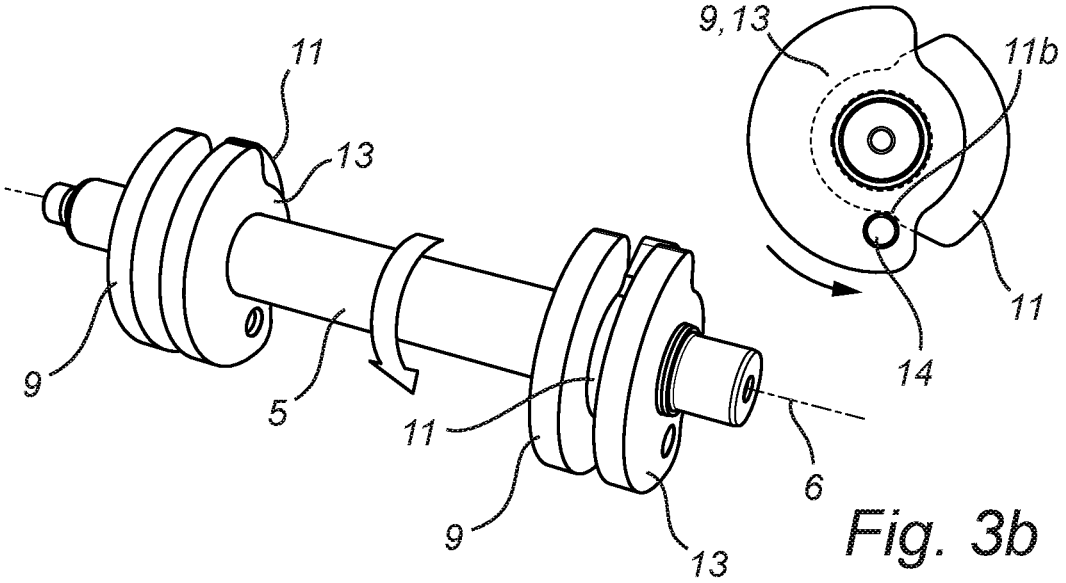

FIG. 2 and FIGS. 3*a-b* illustrate the vibratory mechanism 2 of the vibratory roller 1. The vibratory mechanism 2 comprises a rotatable shaft 5 to which two identical eccentric mass assemblies 7 are mounted. The vibration mechanism 2 serves to generate an eccentric force upon rotation of the shaft 5.

Each eccentric mass assembly 7 comprises three eccentric masses 9, 11, 13 two of which are fixed to the rotatable shaft 5 and one of which is movably mounted on the shaft 5. Each of the movable masses 11 is free to rotate relative to the fixed masses 9, 13 between a first position (FIG. 2), in which it cooperates with the two fixed masses 9, 13 upon rotation of the shaft 5 in one direction, and a second position (FIG. 3*b*), in which it partly balances the two fixed masses 9, 13 upon rotation of the shaft 5 in the opposite direction.

When the movable masses 11 are situated in their respective first positions, the vibratory mechanism 2 operates in a high amplitude setting and when the movable masses 11 are situated in their respective second positions, the vibratory mechanism 2 operates in a low amplitude setting.

The amplitude setting is switched from one to the other by changing the direction of rotation of the shaft 5. To this end, each of the movable masses 11 has two engagement portions 11*a*, 11*b* configured to engage a driving pin 14 secured to the two fixed masses 9, 13 so as to rotate therewith as the shaft 5 rotates in any direction. A first engagement portion 11*a* of each movable mass 11 is configured to engage a respective driving pin 14 when the shaft 5 is rotated in one direction and a second engagement portion 11*b* of each movable mass 11 is configured to engage the respective driving pin 14 when the shaft 5 is rotated in the opposite direction. By changing the direction of rotation of the shaft 5, the movable masses 11 are forced to switch from one position to the other one, as illustrated in FIGS. 3*a-b*. Upon changing the direction of rotation of the shaft 5 the movable masses 11 are thus displaced relative to the fixed masses 9, 13 from one position to the other one. At continued rotation in the same direction, as illustrated by arrows in FIG. 3*b*, each of the movable masses 11 rotates together with the fixed masses 9, 13.

Hence, the vibratory mechanism 2 of the vibratory roller 1 has in this case two and only two amplitude settings in the form of a high amplitude setting (FIG. 2) and a low amplitude setting (FIG. 3*b*).

Figure 4:
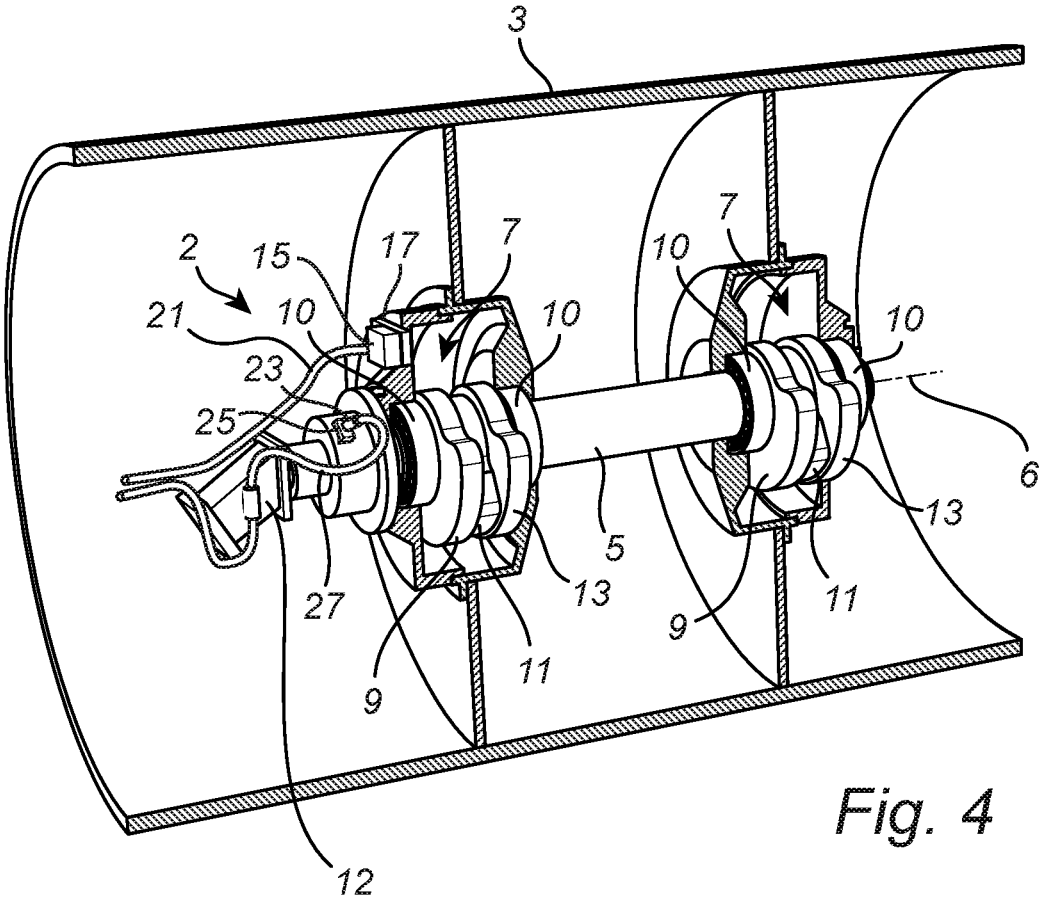
FIG. 4 is a schematic sectional view and illustrates a roller drum of a dual amplitude vibratory roller.

Now referring to FIG. 4, an accelerometer 15 is arranged vertically above the axis of rotation 6 of the roller drum 3. The accelerometer 15 is attached to a non-rotating structure 17 and is capable of measuring the vertical acceleration of the drum 3. The accelerometer 15 is connected to a control unit 19, illustrated in FIG. 5, by a cable 21. During operation of the vibratory roller the control unit 19 continuously receives an acceleration signal from the accelerometer 15.

An eccentric position sensor 23 is arranged to provide a position signal when a reference point on the shaft 5 pass a certain position. The eccentric position sensor 23, which is attached to a non-rotating structure 25, is connected to the control unit 19 by a cable 27. During operation of the vibratory roller 1 the control unit 19 continuously receives a position signal from the eccentric position sensor 23.

The eccentric shaft 5 is rotatably arranged by means of roller bearings 10. A hydraulic motor 12 is arranged for rotating the shaft 5.

A vibratory roller 1 of this type can be operated in different compaction modes depending on the setting of the amplitude, frequency and the stiffness of the soil to be compacted.

In a first compaction mode, also referred to as "continuous contact mode", the roller drum 3 remains in contact with the soil all the time during vibration.

When the soil gets stiffer the vibratory roller 1 enters a second mode of operation, also referred to as "partial uplift mode". When the soil is getting even stiffer, the roller enters a third mode of operation, also referred to as "double jump mode" or "bouncing mode". In the bouncing mode of operation the force between the roller drum 3 and the soil is very high every second cycle and lower or zero every second cycle of vibration. The high contact forces in the bouncing mode are harmful to the vibratory roller 1. Also, the high contact force loosens the top layer of the soil already being compacted and may crush soil particles. It is therefore desired to avoid the bouncing mode of operation.

There are known methods for detecting bouncing. According to one commonly used method, bouncing is detected using frequency analysis of the vibration of the roller drum. More specifically, bouncing is detected by performing Fast Fourier Transform of an acceleration signal indicative of the vertical acceleration of the roller drum as it operates.

By considering the roller drum 3 and the soil/ground as a dynamic system having a characteristic resonance frequency and running the vibratory roller 1 close to the resonance frequency of the soil-drum system compaction can be improved. This gives maximum contact force and effective transfer of vibration energy into the ground, i.e. improved efficiency.

Figure 5:
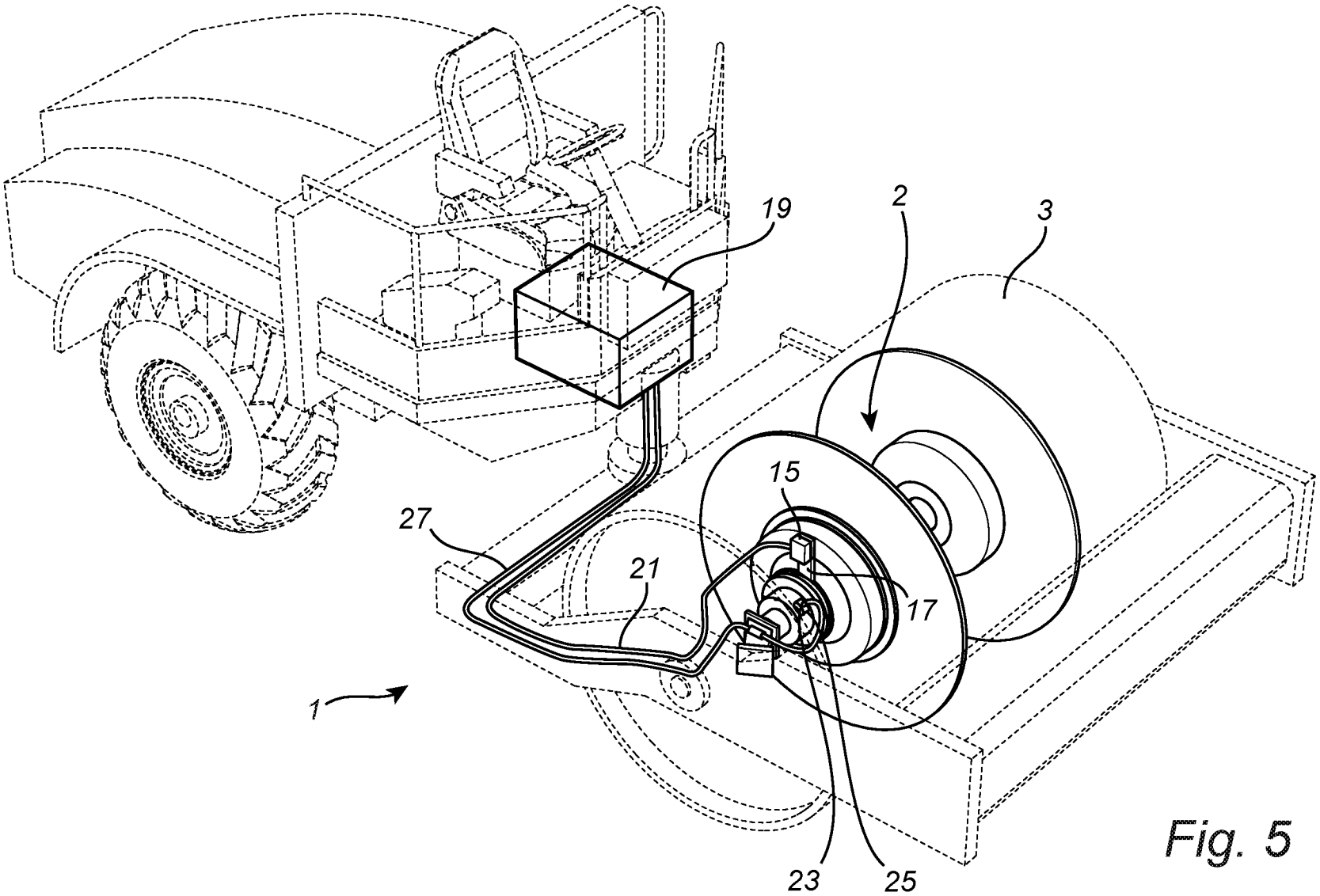
FIG. 5 is a schematic side view and illustrates sensors mounted on a non-rotating member of the roller drum shown in FIG. 4.

With reference to FIG. 4 and FIG. 5, a method of controlling operation of a vibratory roller 1 according to an embodiment of the present disclosure will now be described.

The vibratory roller 1 is started at a default vibration frequency, such as e.g. 20 Hz, and with the vibratory mechanism 2 set in the low amplitude setting or in the high amplitude setting. Preferably, the vibratory mechanism 2 is set in the high amplitude setting.

When the vibratory roller 1 operates the vibration frequency is continuously controlled so as to maintain a predefined phase angle $\Phi$, i.e. the difference in angular position of the eccentric force and the displacement of the roller drum 3, to achieve optimal compaction efficiency and/or energy efficiency. Typically, a predefined phase angle $\Phi$ in the range of 125° to 135° degrees is used for this purpose.

The vertical acceleration of the roller drum 3 is measured by the accelerometer 15 situated vertically above the axis of rotation 6 of the roller drum 3. The moment when a reference point on the shaft 5 passes a certain position is measured using the eccentric position sensor 23.

The actual phase angle is determined based on signals from each of the accelerometer 15 and the eccentric position sensor 23. The phase angle is determined continuously by the control unit 19 and used as a control parameter for controlling the frequency of the vibratory mechanism 2, which provides for quick and accurate control of the vibration frequency of the vibratory roller.

If the phase angle deviates from the predefined phase angle, the vibration frequency is immediately adjusted by the control unit 19. Since the vibratory roller 1 already from start may work at the high amplitude setting the vibration frequency adjusts quickly to the predefined phase angle, i.e. to the optimal phase angle.

Also, a so called bouncing indication value (BIV) is continuously calculated using a frequency analysis of the acceleration signal from the accelerometer 15. The bouncing indication value is calculated to detect when the vibratory roller 1 enters the bouncing mode of operation. The bouncing indication value is calculated as follows:

$$BIV=C*(A_{0.5\Omega}/A_{\Omega}), \text{ where}$$

$A_{\Omega}$=the amplitude of the vertical drum acceleration at the fundamental (vibration) frequency Ω, and $A_{0.5\Omega}$=the amplitude of the vertical drum acceleration of the first subharmonic, i.e. half the vibration frequency Ω.

C is a constant established during site calibrations. (C=300 is often used).

When the BIV exceeds a predefined limit value, also referred to as bouncing value (BV), the drum 3 has entered bouncing mode. Then, the vibration mechanism 2 is automatically turned off by a bouncing guard of the control unit 19 to prevent the vibratory roller 1 from operating in a bouncing mode.

When the bouncing guard has turned off the vibrations, a message is displayed to the operator that bouncing has occurred. The operator must then switch to the low amplitude setting or continue with the vibrations turned off to be able to carry on with the compaction work in the specific area. In fact, the bouncing guard will prevent further compaction work at the high amplitude setting in the specific area, since the BIV will exceed the specified limit value if the operator turns the vibration on at the high amplitude setting.

The person skilled in the art realizes that the present invention by no means is limited to the embodiments described above. On the contrary, many modifications and variations are possible within the scope of the appended claims.

By way of an example, the method has been illustrated for controlling operation of a dual-amplitude vibratory roller of a certain type. It is however appreciated that the method can be used to control operation of other type of dual amplitude vibratory rollers as well as vibratory rollers having further amplitude settings.

The invention claimed is:

1. A method of controlling operation of a vibratory roller, comprising:

operating a vibratory mechanism of the vibratory roller in one of at least two amplitude settings;

controlling a vibration frequency of the vibratory mechanism to maintain a predefined phase angle range, wherein a phase angle is a difference in angular position between an eccentric force generated by the vibratory mechanism and a displacement of a roller drum of the vibratory roller;

determining a bouncing indication value, wherein the bouncing indication value is based on an acceleration signal indicative of a vertical acceleration of the roller drum; and upon detection of a bouncing indication value that exceeds a predetermined threshold, turning off the vibratory mechanism.

2. The method of claim 1, further comprising continuously calculating the bouncing indication value.

3. The method of claim 1, wherein the vibratory mechanism is initially operated in a high amplitude setting.

4. The method of claim 1, wherein the vibratory mechanism has only two amplitude settings.

5. The method of claim 1, further comprising adjusting the vibration frequency if the phase angle is outside of the predefined phase angle range.

6. The method of claim 1, wherein the phase angle range is 110° to 150°.

7. The method of claim 1, wherein the phase angle range is 125° to 135°.

8. A vibratory roller, comprising:

a roller drum;

a vibratory mechanism disposed inside the roller drum, the vibratory mechanism comprising a rotatable shaft, a first weight fixed to the shaft, and a second weight connected to the shaft, wherein, in a first position, the second weight aligns with the first weight to create a high amplitude setting of the vibratory mechanism, and in a second position, the second weight partially balances the first weight to create a low amplitude setting of the vibratory mechanism; and a control unit for controlling the vibratory mechanism, the control unit operably coupled to an accelerometer for determining vertical acceleration of the roller drum, wherein the control unit is configured to turn off the vibratory mechanism upon determination of a bouncing indication value indicative of a vertical acceleration of the roller drum that exceeds a predetermined bouncing value, wherein the control unit is operably coupled to an eccentric position sensor for determining a position of the shaft wherein the control unit is unit is configured to determine a phase angle, wherein the phase angle is a difference in angular position between an eccentric force generated by the vibratory mechanism and a displacement of a roller drum of the vibratory roller, and wherein the control unit is configured to determine whether the phase angle is within a predefined phase angle range, and if phase angle is outside of the predefined phase angle range, to adjust the vibration frequency.

9. The vibratory roller of claim 8, wherein the phase angle range is 110° to 150°.

10. The vibratory roller of claim 8, wherein the phase angle range is 125° to 135°.

11. The vibratory roller of claim 8, wherein the vibratory mechanism has only two amplitude settings.

12. The vibratory roller of claim 8, wherein the control unit is unit is configured to perform Fast Fourier Transform of an acceleration signal from the accelerometer indicative of vertical acceleration of the roller drum for determination of the bouncing indication value.

13. A method of controlling operation of a vibratory roller, comprising:

operating the vibratory roller with a vibratory mechanism of the vibratory roller at a high amplitude setting;

controlling a vibration frequency of the vibratory mechanism to maintain a predefined phase angle range, wherein a phase angle is a difference in angular position between an eccentric force generated by the vibratory mechanism and a displacement of the roller drum;

adjusting the vibration frequency if the phase angle is outside of the predefined phase angle range;

determining a bouncing indication value, wherein the bouncing indication value is based on a vertical acceleration of a roller drum of the vibratory roller; and upon detection of a bouncing indication value that exceeds a predetermined threshold, turning off the vibratory mechanism; and then operating the vibratory roller with the vibratory mechanism at a low amplitude setting or with the vibratory mechanism off.

14. The method of claim 13, wherein determining the bouncing indication value comprises performing Fast Fourier Transform of an acceleration signal indicative of vertical acceleration of the roller drum.

15. The method of claim 13, further comprising displaying a message to an operator of the vibratory roller when the vibratory mechanism has been turned off.

* * * * *